US009899803B2

(12) United States Patent
Krüger et al.

(10) Patent No.: US 9,899,803 B2
(45) Date of Patent: Feb. 20, 2018

(54) IGNITION PLUG

(71) Applicant: NORTH-WEST UNIVERSITY, Potchefstroom (ZA)

(72) Inventors: Petrus Paulus Krüger, Potchefstroom (ZA); Barend Visser, Potchefstroom (ZA)

(73) Assignee: NORTH-WEST UNIVERSITY, Potchefstroom (ZA)

( * ) Notice: Subject to any disclaimer, the term of this patent is extended or adjusted under 35 U.S.C. 154(b) by 0 days.

(21) Appl. No.: 15/522,267

(22) PCT Filed: Oct. 28, 2015

(86) PCT No.: PCT/IB2015/058299
§ 371 (c)(1),
(2) Date: Apr. 26, 2017

(87) PCT Pub. No.: WO2016/067209
PCT Pub. Date: May 6, 2016

(65) Prior Publication Data

US 2017/0324222 A1 Nov. 9, 2017

(30) Foreign Application Priority Data

Oct. 28, 2014 (ZA) ..... 2014/07851

(51) Int. Cl.
*H01T 13/20* (2006.01)
*H01T 13/50* (2006.01)
(Continued)

(52) U.S. Cl.
CPC ..... *H01T 13/20* (2013.01); *H01T 13/50* (2013.01); *H01T 13/52* (2013.01); *H01T 19/00* (2013.01)

(58) Field of Classification Search
CPC ..... H01T 13/20; H01T 13/50; H01T 13/52; H01T 19/00
See application file for complete search history.

(56) References Cited

U.S. PATENT DOCUMENTS 4,798,991 A 1/1989 Benedikt et al.
8,578,902 B2 11/2013 Permuy et al.
(Continued)

FOREIGN PATENT DOCUMENTS

DE 3533124 A1 3/1987
DE 102006037037 A1 2/2008
(Continued)

OTHER PUBLICATIONS

International Search Report and Written Opinion received in PCT/IB2015/058299 dated Jan. 26, 2016; 11 pages.
(Continued)

*Primary Examiner* — Anne Hines
(74) *Attorney, Agent, or Firm* — Knobbe, Martens, Olson & Bear LLP

(57) ABSTRACT

An ignition plug 10 comprises an elongate cylindrical body 12 of an electrically insulating material having a first end 12.1, a second end 12.2 opposite to the first end and a first face 14 at the first end. A first elongate electrode 16 having a first end 16.1 and a second end 16.2 extends longitudinally in the body. The first electrode terminates at the first end thereof a first distance d1 from the first end of the body in a direction towards the second end of the body. The body hence defines a blind bore 18 extending between the first end of the first electrode and the first end of the body. A second electrode is provided on an outer surface of the body and terminates at one of a) flush with the first face 14 of the body and b) a second distance d2 from the first end of the body in a direction towards the second end of the bod.

9 Claims, 2 Drawing Sheets

Figure 1:
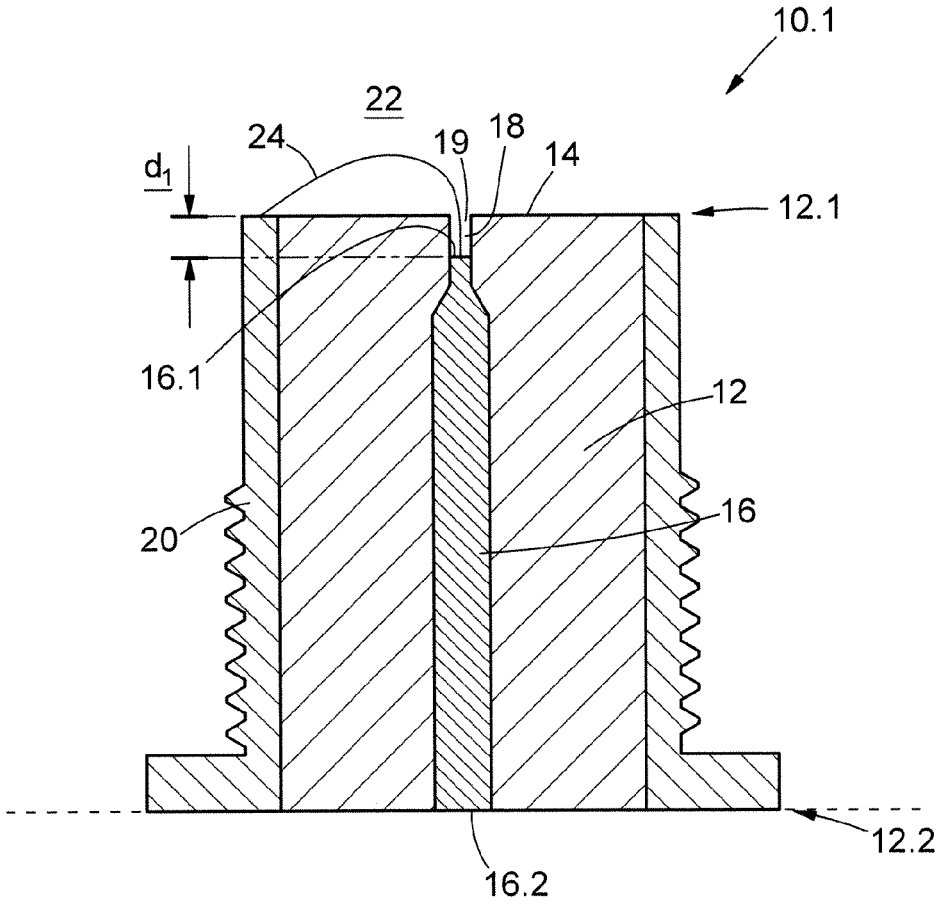

(51) Int. Cl.
*H01T 13/52* (2006.01)
*H01T 19/00* (2006.01)

(56) References Cited

U.S. PATENT DOCUMENTS

| | | | |
|---|---|---|---|
| 8,726,871 | B2 | 5/2014 | Burrows |
| 2010/0212620 | A1 | 8/2010 | Shimizu |
| 2013/0003251 | A1 | 1/2013 | Durham et al. |

FOREIGN PATENT DOCUMENTS

| | | | |
|---|---|---|---|
| NL | 70047 | C | 12/1951 |
| WO | WO 2012/058140 | A2 | 5/2012 |

OTHER PUBLICATIONS

Written Opinion receive in PCT/IB2015/058299 dated Oct. 4, 2016;
5 pages.

IGNITION PLUG

REFERENCE TO RELATED APPLICATIONS

This application is the U.S. National Phase of International Applicaton PCT/IB2015/052299, filed Oct, 28, 2015, and claims priority to ZA Application No. 2014/07851, filed Oct. 28, 2014. Each of the priority applications is hereby incorporated by reference in its entirety.

INTRODUCTION AND BACKGROUND

This invention relates to an ignition plug for an internal combustion engine.

In order to improve emissions in petrol internal combustion engines, the engine may be operated with exhaust gas recirculation (EGR) or lean air-fuel mixtures. However, combustion stability may become unacceptable under these conditions, when using known spark plugs and ignition systems. One reason for this is the small volume of gas that is conventionally being ignited across the spark gap (typical 0.8 mm) of a known spark plug.

It has been shown that the combustion stability may be improved by igniting a larger volume of gas by using larger gap corona ignition systems. However, such systems require higher voltages, which often are problematic. For example, the higher voltages may lead to breakthrough in the ceramic body of the plug, back arcing in the plug, etc. Some known corona systems comprise sharp electrodes extending into the combustion chamber for igniting a larger volume of gas. However, these electrodes may become too hot under certain conditions, which may result in combustion at inappropriate times. Furthermore, with the high voltages (typically about 100 kV) and associated heat, wear of the electrodes become a problem.

Still furthermore, sparks may also occur in corona systems, causing damage to the sharp electrodes. In conventional corona systems, sparking has to be prevented as far as possible to minimise electrode wear and should sparking occur, it has to be controlled to achieve good combustion (see for example U.S. Pat. Nos. 8,578,902 and 8,726,871). As the electrode wears, it becomes blunt, and higher voltages are required to achieve a corona.

OBJECT OF THE INVENTION

Accordingly it is an object of the present invention to provide an ignition plug with which the applicant believes the aforementioned disadvantages may at least be alleviated or which may provide a useful alternative for the known plugs and systems.

SUMMARY OF THE INVENTION

According to the invention there is provided an ignition plug comprising:

- an elongate cylindrical body of an electrically insulating material having a first end, a second end opposite to the first end and a first face at the first end;
- a first elongate electrode extending longitudinally in the body, the first electrode having a first end and a second end, the first electrode terminating at the first end thereof a first distance d1 from the first end of the body in a direction towards the second end of the body;
- the body defining a blind bore between the first end of the first electrode and the first end of the body; and

- a second electrode which is provided on an outer surface of the body and which terminates at one of a) flush with the first face of the body and b) a second distance d2 from the first end of the body in a direction towards the second end of the body.

The body may be circular in transverse cross section and the first electrode may extend axially in the body.

A transverse cross section of the first electrode may decrease towards its first end so that the first electrode terminates at a tip thereof in the blind bore.

The second electrode may be in the form of a sleeve or jacket for the body. The second electrode may extend from a region towards the second end of the body, typically from the second end of the body, towards the first end of the body.

The first face of the body may define hollow formations such as indentations, pits, grooves etc into the first face.

The invention also extends to an ignition system comprising an ignition plug as defined above and a drive circuit for the plug.

Yet further included within the scope of the present invention is a method of igniting a gaseous substance as herein defined and/or described.

More particularly, here is provided a method of igniting a gaseous substance in a chamber, the method comprising:

- utilizing an ignition plug comprising a body of an electrically insulating material; a first electrode extending partially through the body collectively to define at a tip of the first electrode with the body a blind bore in the body, the blind bore being in gas flow communication with the chamber through a mouth in the body; and a second electrode on an external surface of the body;
- driving the first electrode to initialise a corona at the tip, to extend a corona plasma in the blind bore towards the mouth and to eject the plasma into the chamber; and
- controlling the corona plasma to form one of a) a spark extending from the tip of the first electrode along a path which is surrounded by the gaseous substance through the chamber to the second electrode and b) a corona plasma extending from the tip of the first electrode along a path which is surrounded by the gaseous substance into the chamber.

BRIEF DESCRIPTION OF THE ACCOMPANYING DIAGRAMS

Figure 2:
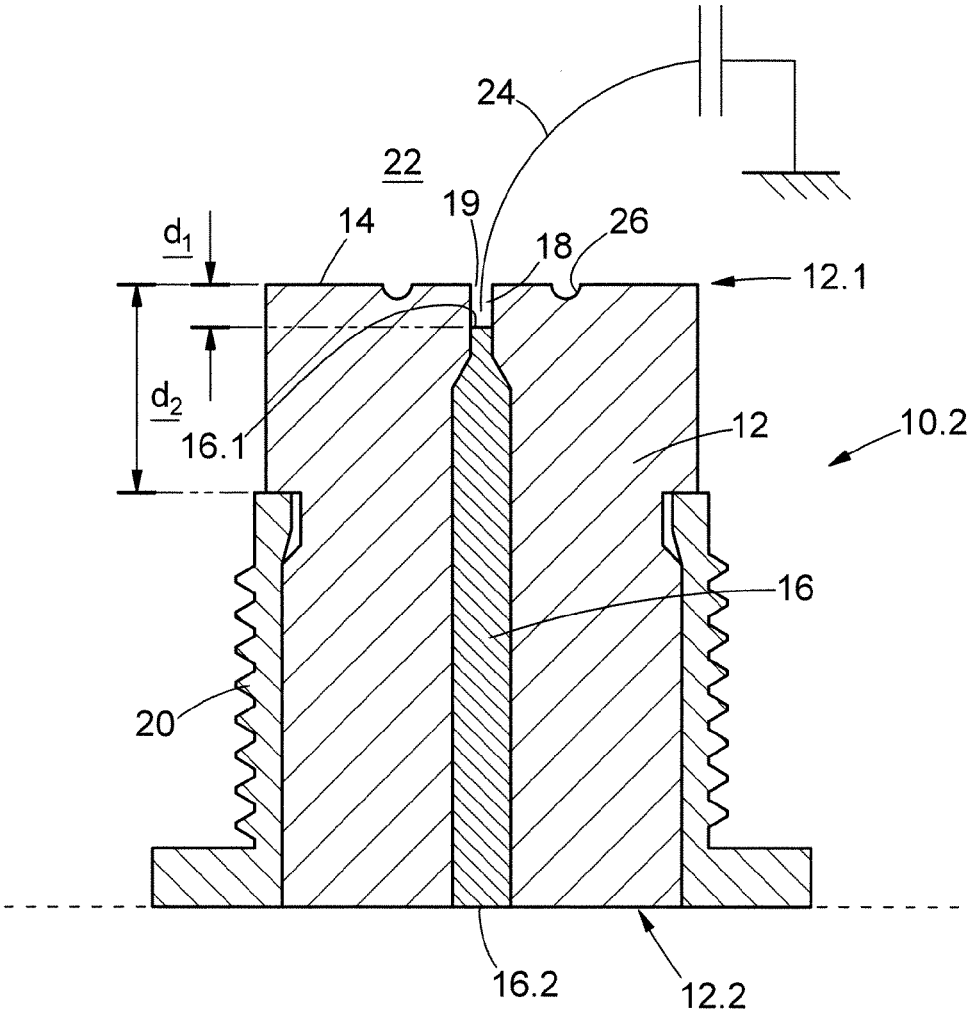

The invention will now further be described by way of example only with reference to the accompanying diagrams wherein:

FIG. 1 is a diagrammatic cross sectional view through a first example embodiment of an ignition plug; and FIG. 2 is a similar view of a second example embodiment of the ignition plug.

DESCRIPTION OF PREFERRED EMBODIMENT OF TH INVENTION

First and second example embodiments of an ignition plug are designated by the reference numerals 10.1 and 10.2 in FIGS. 1 and 2, respectively.

The ignition plug comprises an elongate cylindrical body 12 of an electrically insulating material having a first end 12.1 and a second end 12.2 opposite to the first end. A first face 14 is provided at the first end. A first elongate electrode 16 extends longitudinally in the body 12. The first electrode 16 has a first end 16.1 and a second end 16.2. The first electrode terminates at the first end 16.1 thereof a first distance d1 from the first end 12.1 of the body in a direction towards the second end 12.2 of the body. The body hence defines a blind bore 18 extending between the first end 16.1 of the first electrode and a mouth 19 at the first end 12.1 of the body. A second electrode 20 is provided on an outer surface of the body 12 and the second electrode terminates at one of a) flush with the first face 14 of the body (as shown in FIG. 1) and b) a second distance d2 from the first end 12.1 of the body in a direction towards the second end 12.2 of the body (as shown in FIG. 2).

The body 12 is preferably circular in transverse cross section and may be made of a suitable ceramic material.

In the example embodiments, the second electrode 20 is in the form of a sleeve or jacket for the body 12, extends from the second end of the body towards the first end of the body and, in use, may be grounded or connected to ground potential.

The first electrode 16 may have a first transverse cross sectional area towards its second end 16.2 and for a major part of its length and the first transverse cross sectional area may decrease towards the first end of the electrode, so that the first electrode terminates at the blind end of bore 18 in a tip 16.1 having a second and smaller transverse cross sectional area than the first transverse cross sectional area. The first electrode may be circular in transverse cross section with a diameter large enough (about 1 mm) so that where the first electrode 16 extends through the grounded second electrode 20, the electric field at the interface between the first electrode 16 and body 12 is lower than the breakthrough field of the ceramic body. The tip 16.1 at the blind end of the bore 18 may have a diameter of less than 0.5 mm to generate large enough electric fields in the bore 18.

In the example embodiment of FIG. 1, the second electrode 20 terminates flush with the first face 14. The first embodiment of the ignition plug may be referred to as a spark plug, for reasons set out below.

In the example embodiment of FIG. 2, the second electrode 20 terminates a distance d2 from the first and 12.1 in a direction towards the second end 12.2. The second embodiment of the ignition plug may be referred to as a corona plug, also for reasons set out below.

In use, the electrodes of the plug 10.1 are connected to a suitable drive circuit (not shown) and the plug extends into a chamber 22 of a cylinder (also not shown) of an internal combustion engine (also not shown). A gaseous substance fills the chamber and extends into the blind bore 18. The drive circuit initially generates a corona at the tip 16.1 which heats the gaseous substance in the blind bore. Both the gaseous substance in the blind bore and the corona are then ejected into the combustion chamber 22, resulting in a long plasma body 24 which serves to ignite the gaseous substance in the chamber. Plasma body lengths l of about 10 mm may be achieved.

A volume of the blind bore 18 must be small enough, so that the temperature and pressure of the gaseous substance therein can be raised sufficiently by energy of about 1 mJ. For example, using a bore with d1=1 mm and a diameter of 0.5 mm gives a volume V=0.2 $mm^3$. Air at 300K, 20 bar in V=0.2 $mm^3$ will be raised to a temperature of about 650K and a pressure of about 40 bar, by 1 mJ of energy, if no heat is lost in the ceramic.

In the case of the first embodiment where the grounded second electrode 20 extends to flush with the first face 14, the ejected corona tends to grow towards the second electrode 20, forming a spark. This spark is much longer than the spark in known spark plugs and spark ignition systems, referred to in the introduction of this specification.

In the case of the second embodiment 10.2, where the grounded second electrode 20 terminates a distance d2 from the first end 12.1 of the body 12, the corona 24 tends to grow away from the plug 10.2 and does not form a spark discharge. The first face 14 may define indentations 26, grooves and other formations to assist the corona in growing away from the plug.

In order to achieve the corona ejection, the first electrode must be driven at a high enough voltage at high enough frequency for long enough. The voltage must be high enough so that a corona is formed at the tip 16.1 of the first electrode inside the blind bore 18 and grows towards the mouth. The ceramic next to the electrode tip 16.1 contributes to creating a high enough electric field strength at the tip, making it possible to start a corona at about 30 kV, which is much lower than the above about 100 kV of the known corona systems.

Once the corona is formed, energy must be transferred to the gaseous substance in order to heat the gas. The corona may be seen as a resistive and capacitive load. A high enough voltage must therefore be supplied to transfer enough energy into this load. The frequency at which the voltage is supplied must be high enough (>1 MHz), so that the gas can be heated enough before it is ejected into the combustion chamber. It must also be high enough so that the corona does not follow the first face 14 of the ceramic body 12. At 5 MHz, an electron will travel in the order of 1 mm during each cycle, which is of the same order as the depth d1 of the blind bore 18 and much shorter than the distance from the first electrode to any grounded metal, including the second electrode.

Energy must be supplied to the plug for long enough (typically >100 us) in order to heat the plasma inside the bore and then to further heat the plasma after it is ejected into the combustion chamber.

Hence, one aspect of the invention relates to a method to drive a spark plug 10.1, 10.2 with an electrode 16.1 inside a bore 18 to either generate a corona or a spark that is longer than 5 mm in the combustion chamber, with the corona or spark plasma surrounded by the gaseous substance and not shadowed by any electrode. There are also no electrodes extending into the combustion chamber that could become hot spots.

Drive circuits for and associated methods of driving the ignition plugs are defined and described in the applicant's co-pending International Application entitled "Ignition system for an internal combustion engine and a method of driving an ignition plug of an ignition system", the contents of which are incorporated herein by this reference.

The resulting larger volume of gas which is ignited may result in improved combustion stability at high EGR and lean mixtures. It is believed that the invention may provide for improved combustion stability and may assist engine manufacturers in meeting the enforced emission standards.

The invention claimed is:

1. An ignition plug comprising:

an elongate cylindrical body of an electrically insulating material having a first end, a second end opposite to the first end and a first face at the first end;

a first elongate electrode extending longitudinally in the body, the first electrode having a first end and a second end, the first electrode terminating at the first end thereof a first distance d1 from the first end of the body in a direction towards the second end of the body;

the body comprising internal sidewalls defining a bore having a constant transverse cross sectional area, the sidewalls extending from a mouth at the first end of the body to beyond the first end of the first electrode, so that the sidewalls and the first end, which is located inside the bore, collectively define a blind bore extending from the mouth in a direction towards the second end of the body and terminating at the first end of the first electrode; and a second electrode which is provided on an outer surface of the body and which terminates at one of a) flush with the first face of the body and b) a second distance d2 from the first end of the body in a direction towards the second end of the body.

2. The ignition plug as claimed in claim 1 wherein the body is circular in transverse cross section and wherein the first electrode and the blind bore extend centrally and axially in the body.

3. The ignition plug as claimed in claim 2 wherein the first electrode comprises a first part towards the second end of the first electrode and which first part has a first transverse cross sectional area which decreases towards the first end of the first electrode where the first electrode terminates in a tip which has a second cross sectional area which is smaller than the first cross sectional area.

4. The ignition plug as claimed in claim 1 wherein the first electrode comprises a first part towards the second end of the first electrode and which first part has a first transverse cross sectional area which decreases towards the first end of the first electrode where the first electrode terminates in a tip which has a second cross sectional area which is smaller than the first cross sectional area.

5. The ignition plug as claimed in claim 4 wherein the first and second cross sectional areas are circular.

6. The ignition plug as claimed in claim 1 wherein the second electrode is in the form of a sleeve or jacket for the body.

7. The ignition plug as claimed in claim 1 wherein the first face of the body defines at least one of indentations, hollows pits and grooves.

8. An ignition system comprising an ignition plug as claimed in claim 1; and a drive circuit for the ignition plug.

9. A method of igniting a gaseous substance in a chamber, the method comprising:

utilizing an ignition plug of claim 1;

driving the first electrode to initialise a corona at the tip, to extend a corona plasma in the blind bore towards the mouth and to eject the plasma into the chamber; and a) wherein when the second electrode of the ignition plug terminates flush with the first face, controlling the corona plasma to form a spark extending from the first end of the first electrode along a path which is surrounded by the gaseous substance through the chamber to the second electrode and b) wherein when the second electrode of the ignition plug terminates a second distance d2 from the first end in a direction towards the second end of the body, controlling the corona plasma to extend from the first end of the first electrode along a path which is surrounded by the gaseous substance into the chamber.

* * * * *